US007175043B2

(12) United States Patent
O'Neal

(10) Patent No.: US 7,175,043 B2
(45) Date of Patent: Feb. 13, 2007

(54) LID FOR BEVERAGE CONTAINERS

(76) Inventor: Shawn O'Neal, 5399 E. C30A, PMB 220, Santa Rosa Beach, FL (US) 32459

( * ) Notice: Subject to any disclaimer, the term of this patent is extended or adjusted under 35 U.S.C. 154(b) by 202 days.

(21) Appl. No.: 10/774,223

(22) Filed: Feb. 6, 2004

(65) Prior Publication Data

US 2005/0173434 A1 Aug. 11, 2005

(51) Int. Cl.
*B65D 55/00* (2006.01)
*A47G 19/22* (2006.01)

(52) U.S. Cl. ..... 220/379; 220/713; 220/212

(58) Field of Classification Search ..... 220/379, 220/713, 716, 717, 212, 266, 268; 229/404; 215/399

See application file for complete search history.

(56) References Cited

U.S. PATENT DOCUMENTS

| | | | | |
|---|---|---|---|---|
| 3,806,023 | A * | 4/1974 | Barnett | 229/404 |
| 4,756,440 | A | 7/1988 | Gartner | 220/90.4 |
| 5,050,759 | A | 9/1991 | Marble | 220/90.4 |
| 5,148,937 | A * | 9/1992 | Huard | 220/278 |
| 5,348,181 | A | 9/1994 | Smith et al. | 220/254 |
| 5,509,568 | A | 4/1996 | Warden et al. | 220/711 |
| 5,518,134 | A | 5/1996 | Liu | 220/336 |
| D379,928 | S | 6/1997 | Freek et al. | D9/447 |
| 5,667,094 | A | 9/1997 | Rapchak et al. | 220/339 |
| 5,749,491 | A | 5/1998 | Wylder et al. | 220/719 |
| 5,799,814 | A | 9/1998 | Schafer et al. | 220/254 |
| 5,863,655 | A | 1/1999 | Mock | 428/411.1 |
| 6,047,852 | A | 4/2000 | Evans et al. | 220/793 |
| 6,085,931 | A | 7/2000 | Sadow | 220/375 |
| 6,230,923 | B1 | 5/2001 | Hung | 220/703 |
| 2002/0020708 | A1 | 2/2002 | Weiss et al. | 220/366.1 |
| 2003/0089726 | A1 | 5/2003 | Mazzarolo | 220/712 |

FOREIGN PATENT DOCUMENTS

| | | |
|---|---|---|
| EP | 0 291 326 A1 | 11/1988 |
| EP | 0 269 032 B1 | 6/1992 |
| GB | 2205309 A | 12/1988 |

* cited by examiner

*Primary Examiner*—Robin A. Hylton
(74) *Attorney, Agent, or Firm*—Greenberg Traurig, LLP

(57) ABSTRACT

A disposable lid for beverage containers includes a mechanism enabling a user to hang the lid on the rim of the container, rather than placing the lid on a counter or table top, to avoid actual or perceived unsanitary conditions and to minimize risk of transmitting infectious diseases to the user. The lid includes an integral device for hanging the lid on the rim of the container while being inexpensive to manufacture and efficient to package and transport.

7 Claims, 9 Drawing Sheets

LID FOR BEVERAGE CONTAINERS

BACKGROUND OF THE DISCLOSURE

1. Field of the Invention

The present invention relates in general to beverage container lids, and particularly, disposable beverage container lids having retaining features for temporarily securing the lid onto a beverage container in a position such that the container contents are readily accessible.

2. Background Art

Lids for beverage containers have existed for many years and in a variety of forms. A typical disposable container lid for hot and cold drinks commonly served at fast food restaurants and coffee shops is usually formed from plastic or paper, and is optionally recyclable. Lids of this type are sometimes ergonomically designed to enable a consumer to drink from the container with little, if any, leakage or spillage, and often include means for tightly sealing the lid against the rim of a disposable beverage container.

Consumers of fast food and at coffee shops are increasingly concerned with health issues, which include the maintenance of sanitary conditions. Particularly in urban areas and other areas of high population density, individuals face risk of illness from communicable infection or disease, including illnesses transmitted through person-to-person contact, person-to-object contact, and contact with airborne pathogens. Thus, some businesses have embraced various efforts towards reducing the risk of transmission of infectious diseases, such as the wearing of latex gloves during food preparation and the regular wiping of counters and tabletops with disinfectant cleansers.

One instance in which many individuals entertain an actual or perceived risk of encountering an unsanitary condition is when removing the lid of a disposable cup. For example, coffee shops typically provide their customers with coffee beverages, which require the customer to use a common public kiosk to add any desired cream and/or sugar, and to stir their beverage. Such kiosks are typically used by a large volume of customers, thus precipitating the perception of possible contamination of kiosk countertops. While many customers may desire to set the cup lid down on the kiosk countertop to facilitate the desired preparation of their beverage, they may be hesitant to do so due to the perceived risk of exposure to unsanitary conditions on countertops that may be touched and/or coughed on by large numbers of people. Thus, there exists a need for disposable beverage container lids that, when removed from the container, are temporarily storable so as not to contact the counter or tabletop—thereby eliminating a potential transmission path for infectious diseases.

It is known in different contexts to employ tethering systems or hanging systems to temporarily store a removable closure. For example, some charcoal grill lids include a mechanism inside the grill lid to facilitate the temporary storage of the lid along the outer periphery of the grill so as to eliminate the risk of fire or burning possibly incurred by placing a hot lid on the ground or another surface while cooking. Also, some automobile gasoline caps have cutouts to permit the gas caps to be hung along the top edge of a gasoline cap filler door to prevent users from forgetting and/or losing the gas cap during refueling. However, these applications do not address sanitary concerns raised by handling of beverage container lids, nor are they readily adaptable to the cost, manufacture, storage and packaging requirements of a disposable lid for a beverage container.

Therefore, it would be desirable to provide a disposable or recyclable lid for beverage containers that may be temporarily supported by the container in a position allowing access to the container contents, while minimizing any leakage or spillage of the container contents when secured to the container during normal use. It would also be desirable to provide such a lid for beverage containers that is inexpensive to manufacture and efficient to transport.

SUMMARY OF THE INVENTION

A lid is provided for removable attachment to a cup. The lid may be disposable, and may be created from a recyclable material, such as plastic or paperboard. The lid includes a generally circular top surface. An aperture may be formed in the top surface to permit drinking or dispensing of cup contents while the lid is secured in an attached position. The lid further includes an annular side wall extending downwards from the periphery of the top surface. The annular side wall includes a coupling surface adapted to secure the lid onto the rim of the cup.

In accordance with one aspect of the invention, the annular side wall of the lid includes first and second apertures extending upwards from the lower edge of the annular side wall. The apertures can be placed over the rim of the cup to permit temporary hanging of the lid from the rim, thereby retaining the lid on the cup and away from potentially unclean surfaces, while permitting ready access to the contents of the cup. The first and second apertures may be optionally spaced apart by a distance approximately one-tenth the circumference of the lid. The lid may include a dispensing aperture for permitting dispensing of the cup contents while the lid is in its attached position closing the cup. The dispensing aperture is optionally located towards the periphery of the lid at a position opposite that of the first and second apertures.

In accordance with another aspect of the invention, the lid includes a hook structure formed from the lid side wall. The hook structure may be deformed inward to form a hook adapted to hang the lid from the cup rim. The hook structure can be formed from at least two lines of weakening, which may extend parallel to one another upwards from the lower edge of the side wall, and which are optionally spaced approximately one-eighth of an inch apart. An extension tab may be formed contiguous to the edge of the annular side wall and between the at least two lines of weakening, extending beyond the lower edge of the annular side wall. The lines of weakening may be score lines or lines of perforation, and may include tear arrest structures at their uppermost ends to prevent undesired tearing of the lid structure. The lid may include a dispensing aperture, which may be located towards the periphery of the cup lid at a position approximately opposite that of the hook structure.

In accordance with yet another aspect of the invention, the lid may include a protrusion extending from the top surface of the lid. The protrusion can be positioned to rest on the cup rim to secure the lid along the outer periphery of the cup. The protrusion may include an extension arm and a hook portion, and the hook portion may have a longitudinal cross-section similar in shape to that of a radial cross-section of the cup rim, thereby providing a secure fit.

In accordance with a further aspect of the invention, a method is provided for using a cup having a removable lid. The lid is hung off of the cup rim in a position such that the contents of the cup are readily accessible. The cup contents are then accessed while the lid is retained by the cup rim. Finally, the lid is mounted onto the cup in a different position whereby the lid substantially covers the cup. The step of hanging the lid off of the cup rim can be accomplished by inserting the cup rim into at least two apertures formed in the lid. Alternatively, the hanging of the lid can be performed by deploying a hook structure from the lid and securing the hook structure onto the cup rim. The hook structure can be deployed by separating the hook structure from the lid side wall along at least two lines of weakness formed in the side wall, bending the hook structure inwards towards the center of the lid, and engaging the hook structure with the rim of the cup. Finally, the hanging of the lid from the cup rim can also be accomplished by attaching to the cup rim a protrusion extending downwards from a generally circular top surface of the lid.

DETAILED DESCRIPTION OF THE INVENTION

Figure 1:
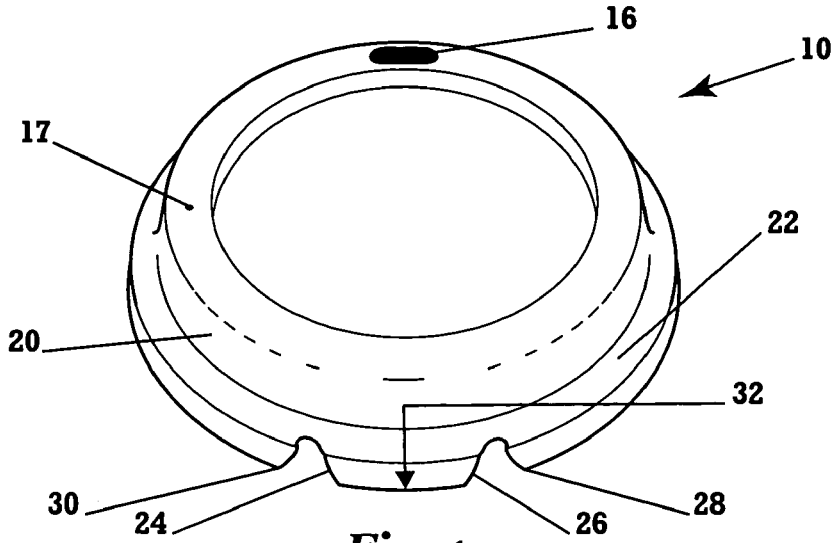
FIG. 1 is a perspective view of a beverage container lid according to one embodiment of the invention.
Figure 2:
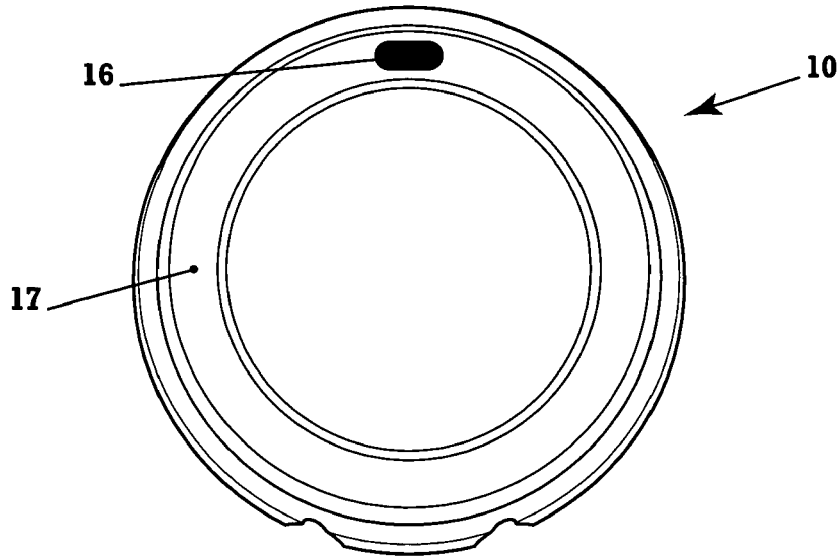
FIG. 2 is a top view of the beverage container lid according to the embodiment of FIG. 1.

While this invention is susceptible of embodiment in many different forms, there are shown in the drawings and will herein be described in detail, certain specific embodiments with the understanding that the present disclosure should be considered as an exemplification of the principles of the invention and is not intended to limit the invention to the embodiments so illustrated.

Figure 3:
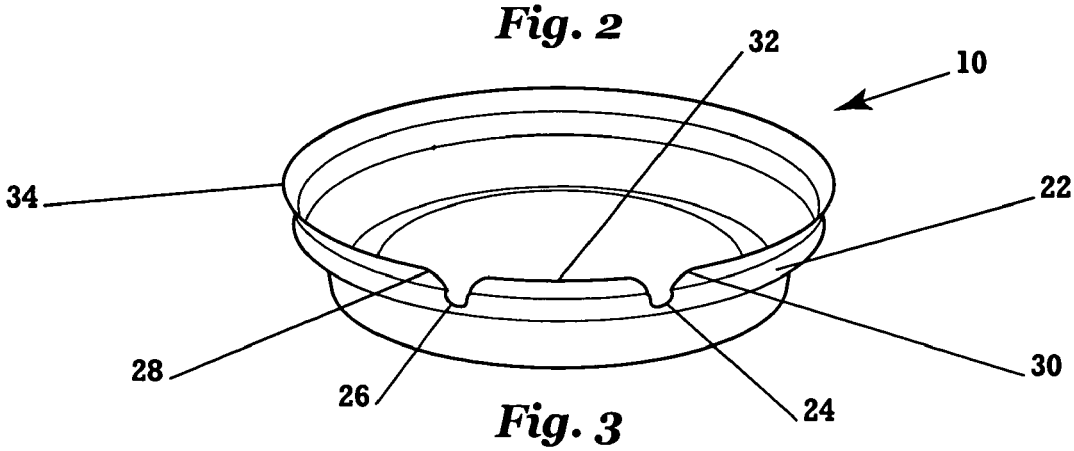
FIG. 3 is another perspective view, shown inverted, of the beverage container lid according to the embodiment of FIG. 1.
Figure 4:
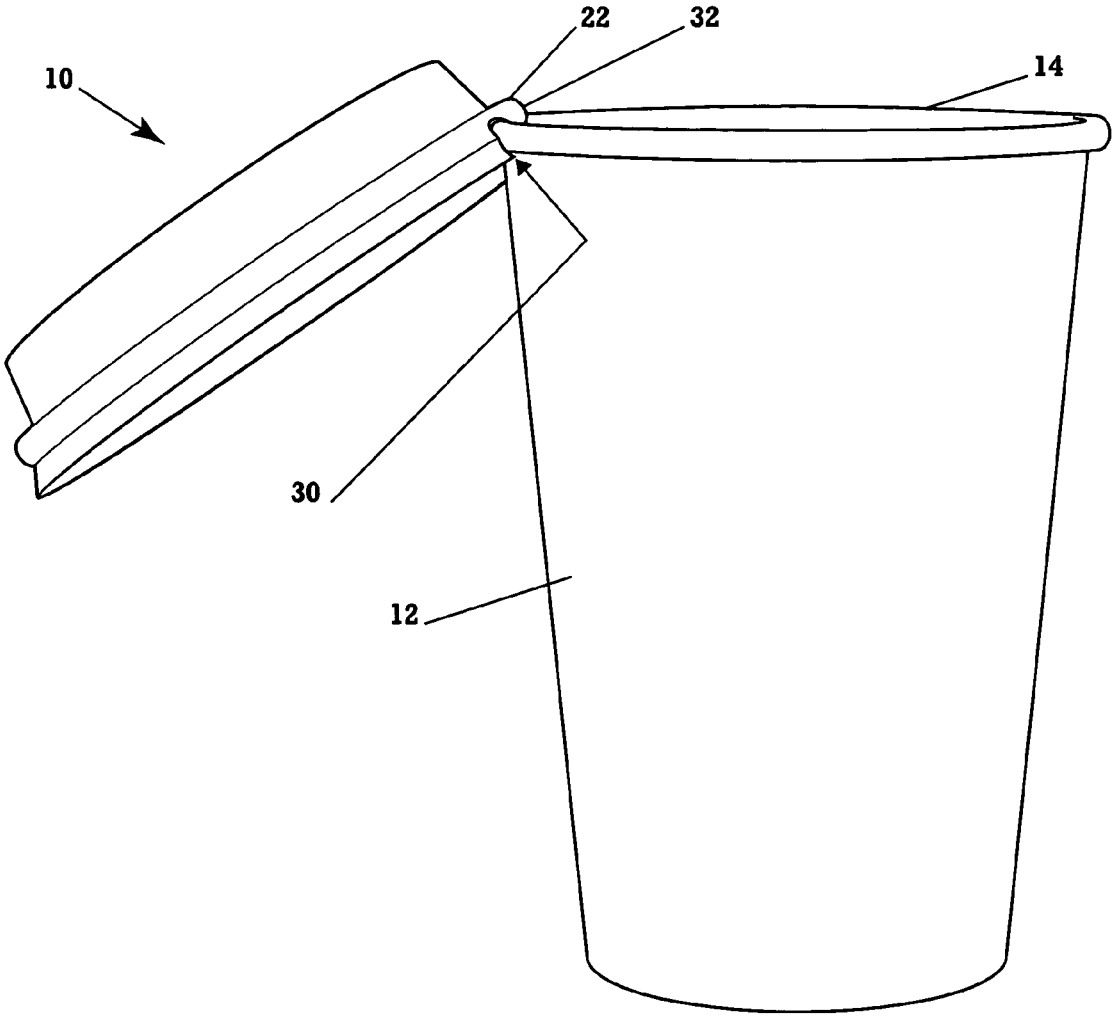
FIG. 4 is a side view of the beverage container lid of FIG. 1 shown in its temporary storage position on a representative beverage container.

According to one embodiment of the invention, beverage container lid 10 is shown in FIGS. 1–7. Lid 10, as illustrated in FIG. 1, is generally circular in shape and includes aperture 16 for drinking or dispensing fluids from within beverage cup 12 (FIG. 4). For improved fluid flow during dispensing, lid 10 may also incorporate at least one breather hole, such as breather holes 17 and 18 of FIG. 2. Lid 10 further includes side wall 20 having an annular attachment portion 22 for securely, yet removably, connecting lid 10 to rim 14 (FIG. 5) on beverage cup 12 while preventing leakage of the contents of beverage cup 12 during use. It is understood that while lid 10 is generally circular in shape, the top surface of the lid may include variations in elevation to form structures such as a ridge around the perimeter of the lid top surface, or a receptacle in the lid surface to facilitate drinking, such as are known in the relevant art. Preferably, lid 10 is fabricated from disposable and/or recyclable materials, such as thermoplastics (i.e., polystyrene and the like), or paperboard.

FIG. 3 shows beverage container lid 10 in an inverted position. Annular attachment portion 22 includes apertures 24 and 26 originating at the lower edge 34 of side wall 20 and extending into side wall 20. To insure proper sealing of beverage cup 12 along the entire perimeter of beverage cup rim 14 (FIG. 5), apertures 24 and 26 preferably do not extend into side wall 20 beyond that point at which cup rim 14 contacts annular attachment portion 22 when lid 10 is mounted on cup 12. Annular attachment portion 22 further includes corners 28 and 30 and hook 32, each of which are created by the formation of apertures 24 and 26. Apertures 24 and 26 may be fabricated in lid 10 by the manufacturer or, alternatively, may be created by the consumer by severing side wall 20 of lid 10 along lines of weakness fabricated in the lid by the manufacturer defining apertures 24 and 26.

Figure 5:
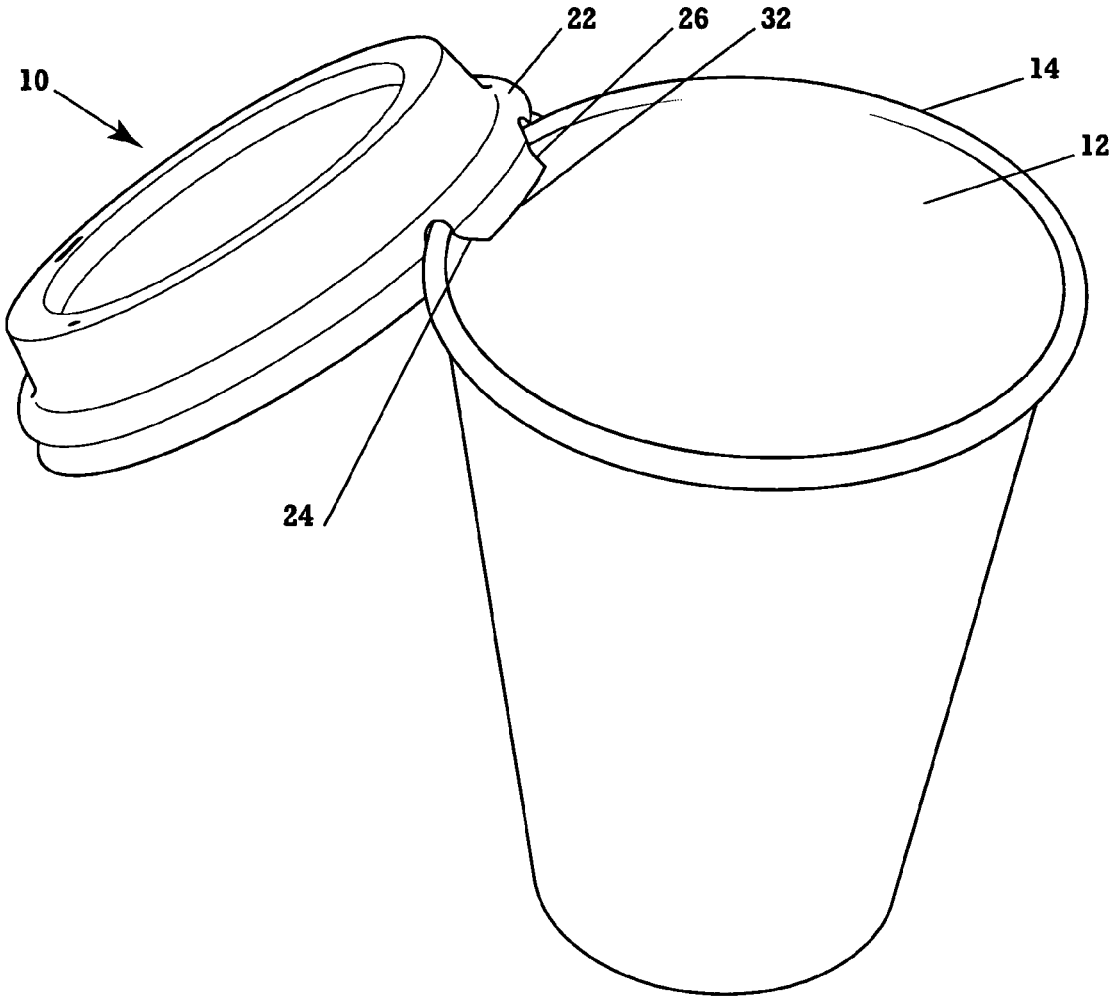
FIG. 5 is a perspective view of the beverage container lid of FIG. 1 shown in its temporary storage position on a representative beverage container.
Figure 6:
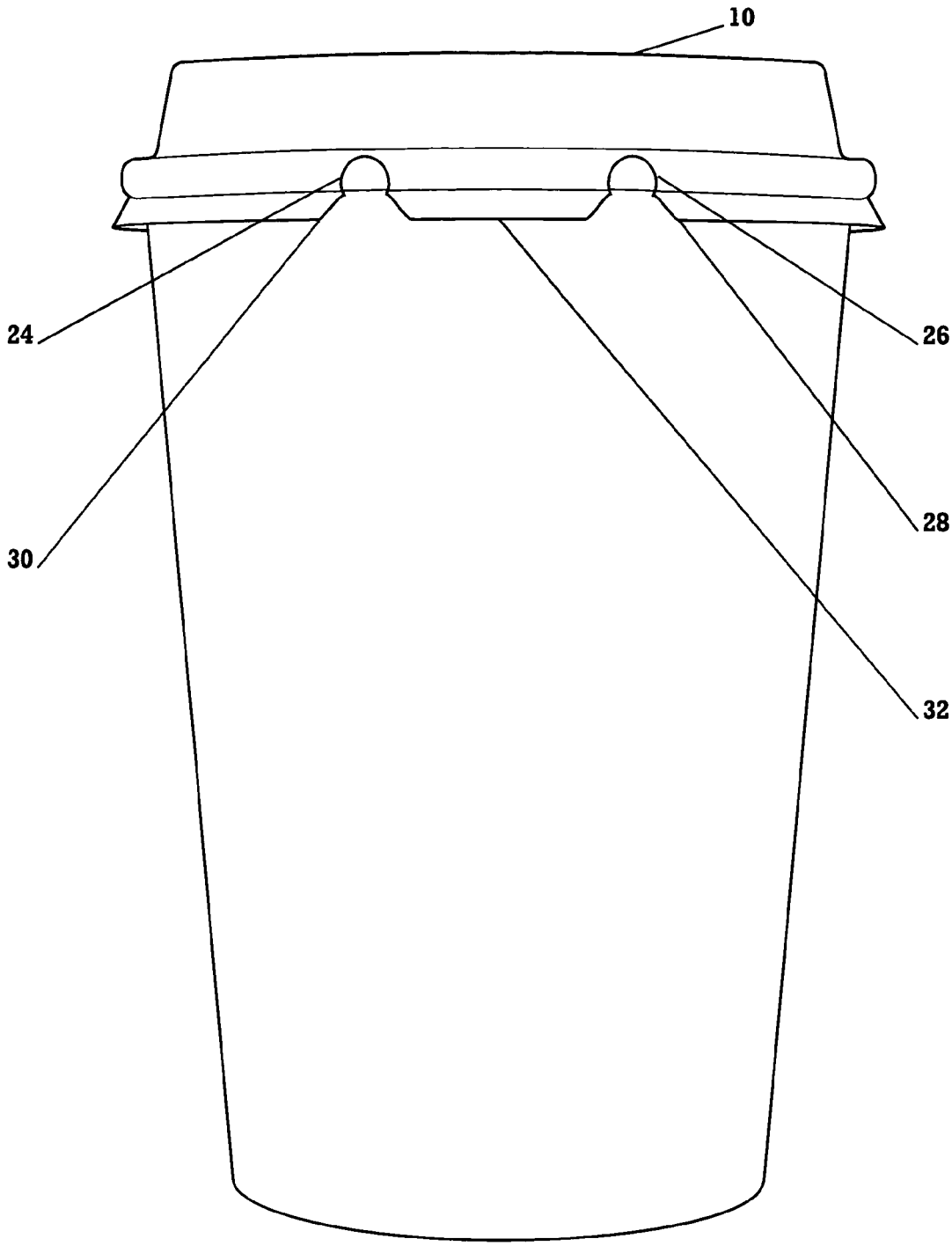
FIG. 6 is a side view of the beverage container lid of FIG. 1 shown mounted atop a representative beverage container during normal use.
Figure 7:
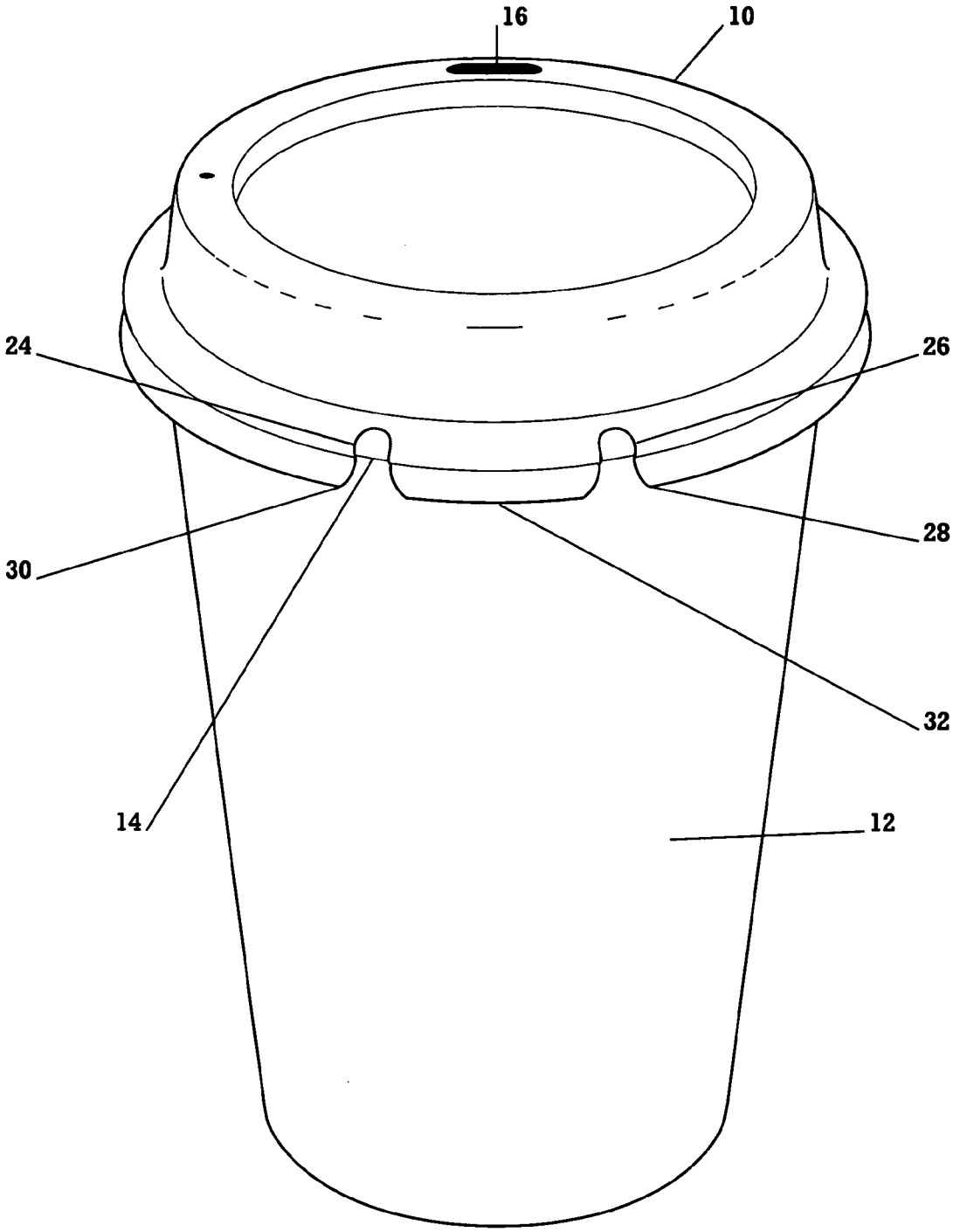
FIG. 7 is a perspective view of the beverage container lid of FIG. 1 shown mounted atop a representative beverage container during normal use.
Figure 8:
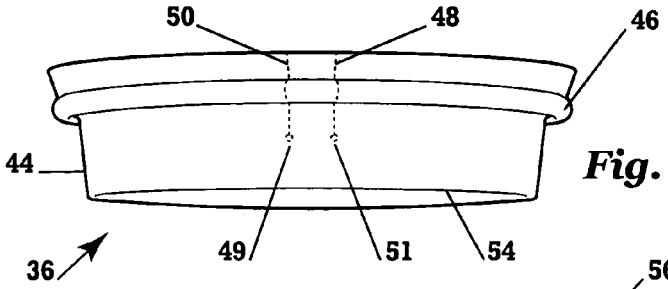
FIG. 8 is an inverted side view of a beverage container lid according to another embodiment of the invention.
Figure 9:
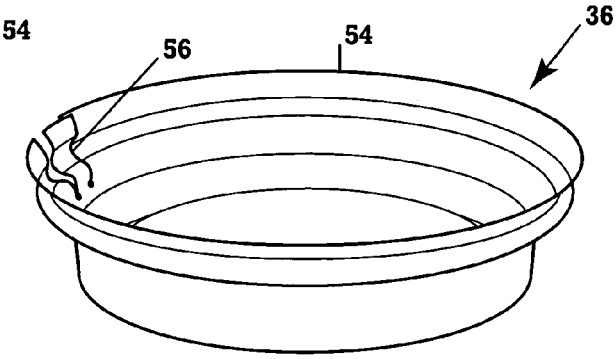
FIG. 9 is a perspective view, shown inverted, of the beverage container lid of FIG. 8 shown with an articulated hook.

FIGS. 4–5 show the improved beverage container lid 10 mounted to beverage cup 12 in the temporary open position, whereby the user is provided with access to the contents of cup 12. In the position of FIGS. 4 and 5, the lid facilitates the refilling of hot or cold beverages, the addition of cream and/or sugar to coffee beverages, etc., without setting lid 10 down upon potentially unsanitary surfaces. Lid 10 is hung from rim 14 by lowering lid 10 to position apertures 24 and 26 over rim 14, then rotating lid 10 downward to engage hook 32 over rim 14, while also wedging corners 28 and 30 underneath rim 14. Conversely, upwardly rotating and lifting lid 10 releases lid 10 from rim 14, such that lid 10 can be remounted on cup 12 in the closed position, shown in FIGS. 6–7.

Optionally, apertures 24 and 26 are located along annular attachment portion 22 at a location that is approximately opposite from the side of lid 10 at which drinking aperture 16 is positioned. Thus, to the extent that the seal between cup rim 14 and lid 12 may be weakened when in the closed position due to the presence of apertures 24 and 26, the location of the potentially weakened seal is one that is less likely to be regularly exposed to the contents of beverage cup 12 during typical drinking activity.

Because the temporary hanging mechanism is comprised of apertures in beverage cup lid 10, such that no portion of the lid 10 lies outside the plane of side wall 20, lid 10 can be readily and efficiently stacked with other like lids for convenience and space-efficient packaging, storage and transportation.

An alternative embodiment of the invention is illustrated in FIGS. 8–11. Like lid 10, improved beverage container lid 36 is generally circular in shape and includes hole 42 (see FIG. 11) for drinking or dispensing fluids from within beverage cup 38. For improved fluid flow during dispensing, lid 36 optionally incorporates breather hole 43 (see FIG. 11). Lid 36 further comprises side wall 44 having an annular attachment portion 46 for securely, yet removably, connecting lid 36 to rim 40 of beverage cup 38 to prevent leakage of the contents of beverage cup 38 during use. Preferably, lid 36 is fabricated from disposable and/or recyclable materials, such as thermoplastics (i.e., polystyrene and the like), or paperboard.

Annular side wall 44 includes lines of weakness 48 and 50, oriented parallel to one another. Lines of weakness 48 and 50 originate at lower edge 52 of side wall 44 and extend toward the top edge 54 of side wall 44. A temporary mounting hook 56 can be formed by severing side wall 44 at lines of weakness 48 and 50, then bending the material between the lines of weakness 48 and 50 inwards towards the center of lid 36 to form hook 56, as shown in the articulated configuration in FIG. 9. Lines of weakness 48 and 50 can be formed from structures such as score lines or perforation lines. Optionally, propagation of the resultant "tear" along lines of weakness 48 and 50 may be arrested via any number of known solutions, such as by incorporation of tear arresting structures 49 and 51, or tear arrest fillets, at the desired termination points in side wall 44, or via a change in the directional orientation of the raw material from which the lid is formed at the desired point of termination for the lines of weakness.

The portion of side wall 44 that is bent inward to form hook 56 may be optionally fabricated by the lid manufacturer to extend below lower lid edge 52 for easy identification of the "tear tab" along the periphery of the lid by a consumer. Also, lines of weakness 49 and 51 can also be fabricated by the lid manufacturer as score lines extending through the entire thickness of lid 36, thereby avoiding the need for a user to engage in the tab tearing operation prior to use of hook 56 for temporarily mounting lid 36 onto rim 40 of cup 38.

Figure 10:
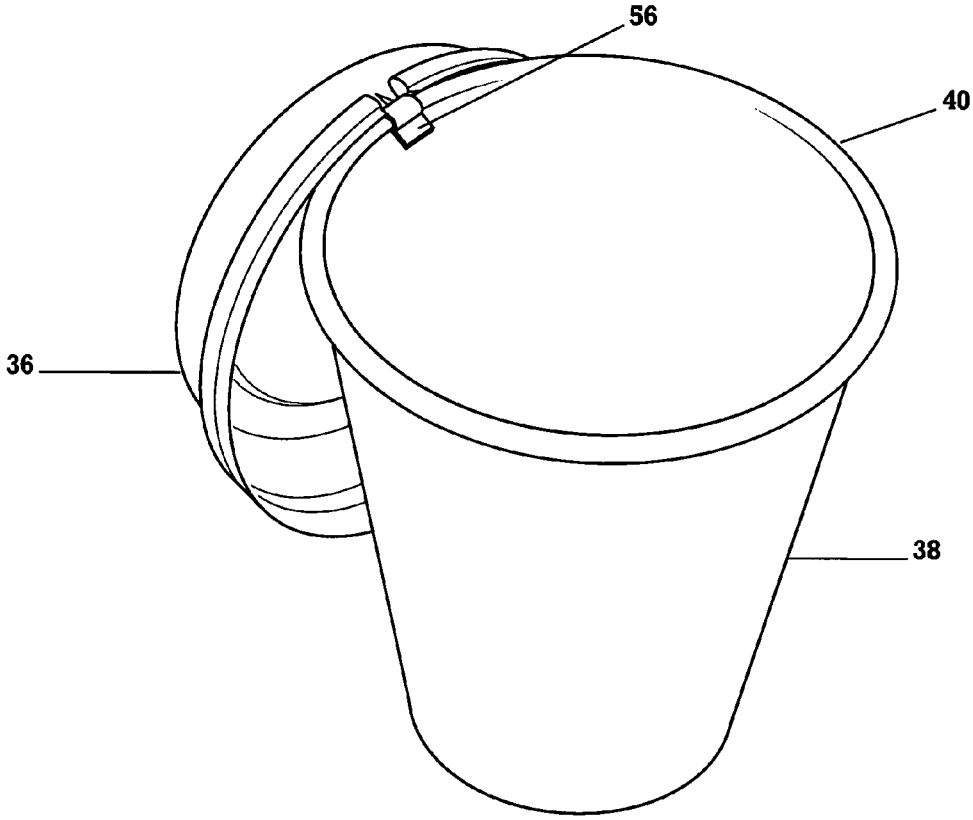
FIG. 10 is a perspective view of the beverage container lid of FIG. 8 shown in its temporary storage position on a representative beverage container.

FIG. 10 illustrates lid 36 in its temporary mounting position, facilitating access to the contents of cup 38. Lid 36 can be removably mounted on cup 38 by hanging lid 36 from cup rim 40 by articulated hook 56. As is apparent from the illustration of FIG. 10, lid 36 may be hung from any point along the periphery of cup rim 40.

Figure 11:
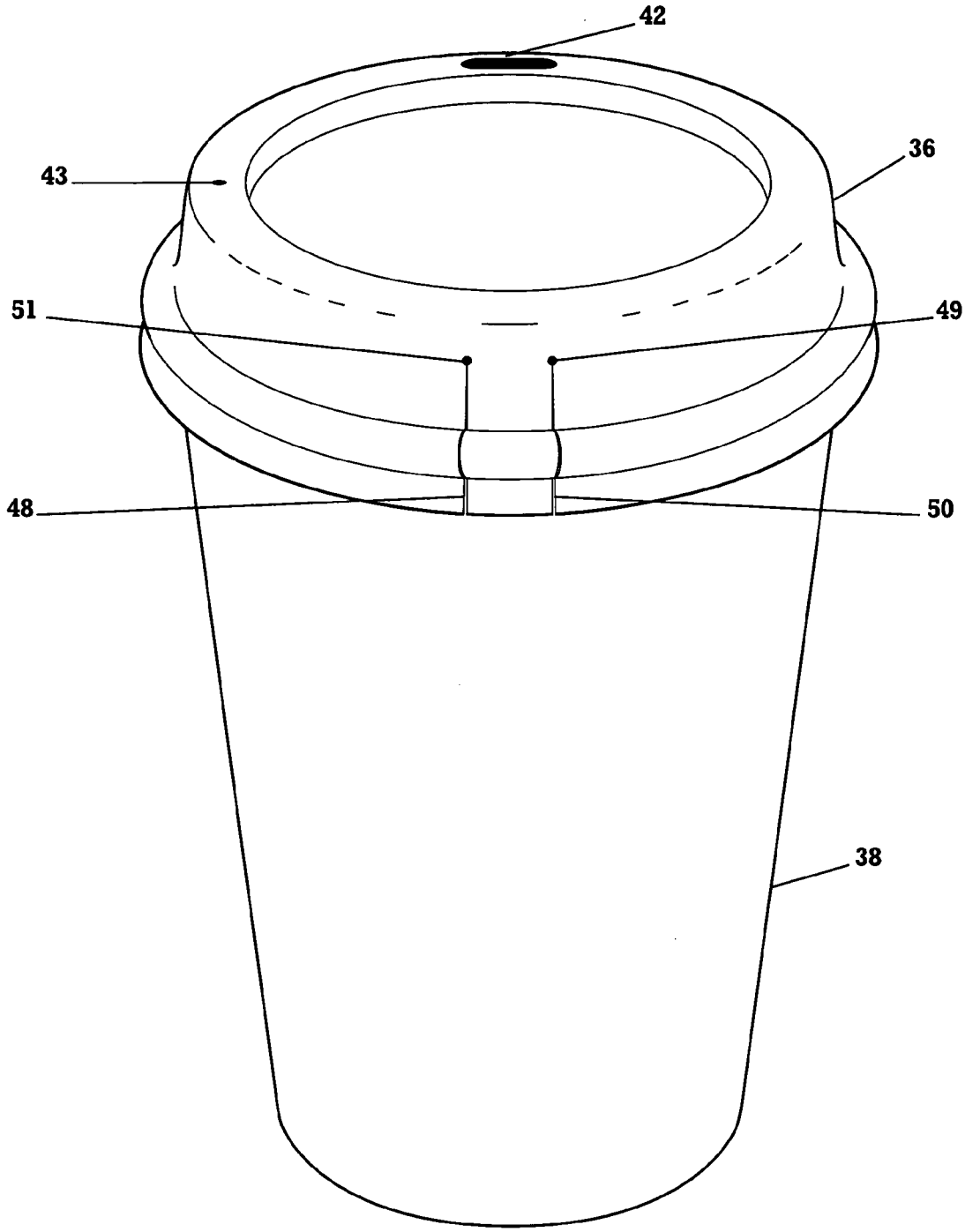
FIG. 11 is a perspective view of the beverage container lid of FIG. 8 shown mounted atop a representative beverage container during normal use.

FIG. 11 illustrates a perspective view of lid 36 mounted on cup 38 in a closed position, whereby the contents of cup 38 can be consumed or transported with reduced risk of spillage. When lid 36 is remounted on cup 38, previously-articulated hook 56 is forced back outwards by cup rim 40 to lie flush with the remainder of annular side wall 44 and to form a seal with cup rim 40 to prevent spillage of the contents of cup 38. Also, it may be desirable in some applications to minimize the risk of content leakage through score lines 48 and 50 by positioning hook 56 at a location on lid 36 that is least likely to be exposed to the contents of cup 38, such as a portion of lid 36 that lies opposite the location of drinking hole 42.

Like lid 10, lid 36 also includes no portions lying outside the plane of side wall 44 as long as hanger 56 is placed into its non-articulated position, thereby facilitating convenient and space-efficient packaging, storage and transportation.

Figure 12:
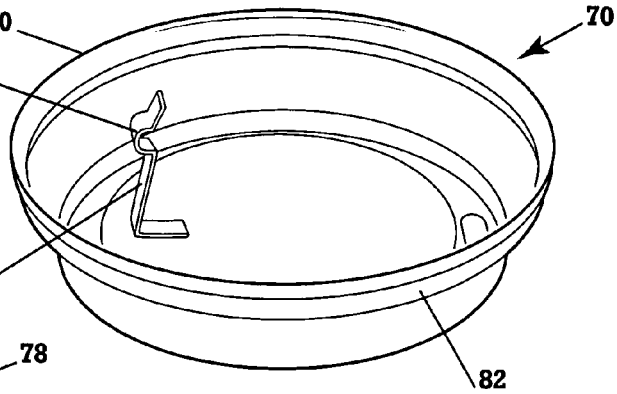
FIG. 12 is a perspective view, shown inverted, of an alternative embodiment of the invention.
Figure 13:
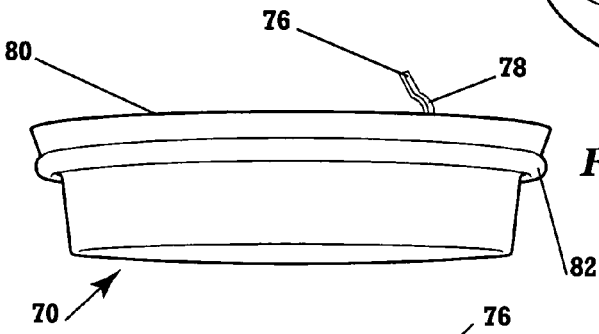
FIG. 13 is an inverted side view of the alternative embodiment of FIG. 12 shown with an articulated protrusion and hook.
Figure 14:
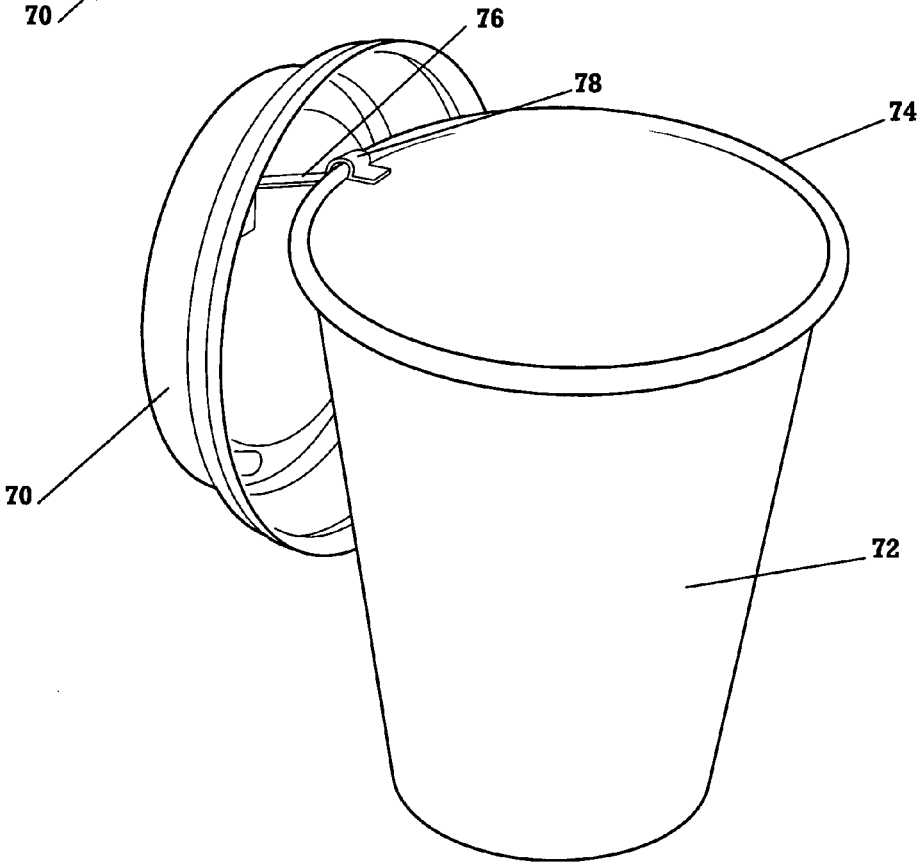
FIG. 14 is a perspective view, of the alternative embodiment of FIG. 12 shown in its temporary storage position on a representative beverage container.
Figure 15:
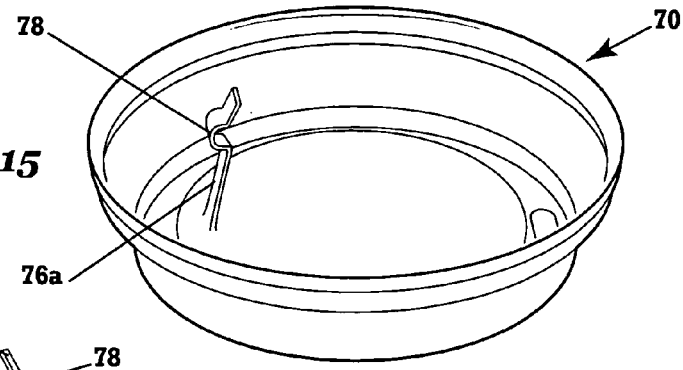
FIG. 15 is an inverted perspective view of the alternative embodiment of FIG. 12 shown with an integral protrusion.
Figure 16:
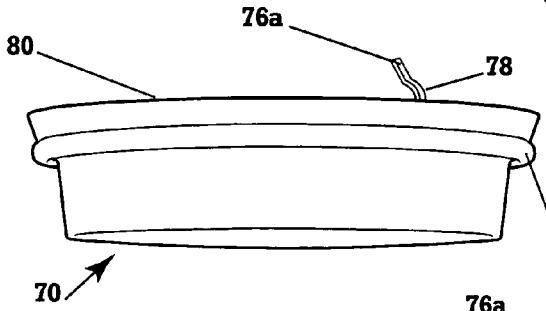
FIG. 16 is an inverted side view of the alternative embodiment of FIG. 15 shown with an articulated protrusion and hook.
Figure 17:
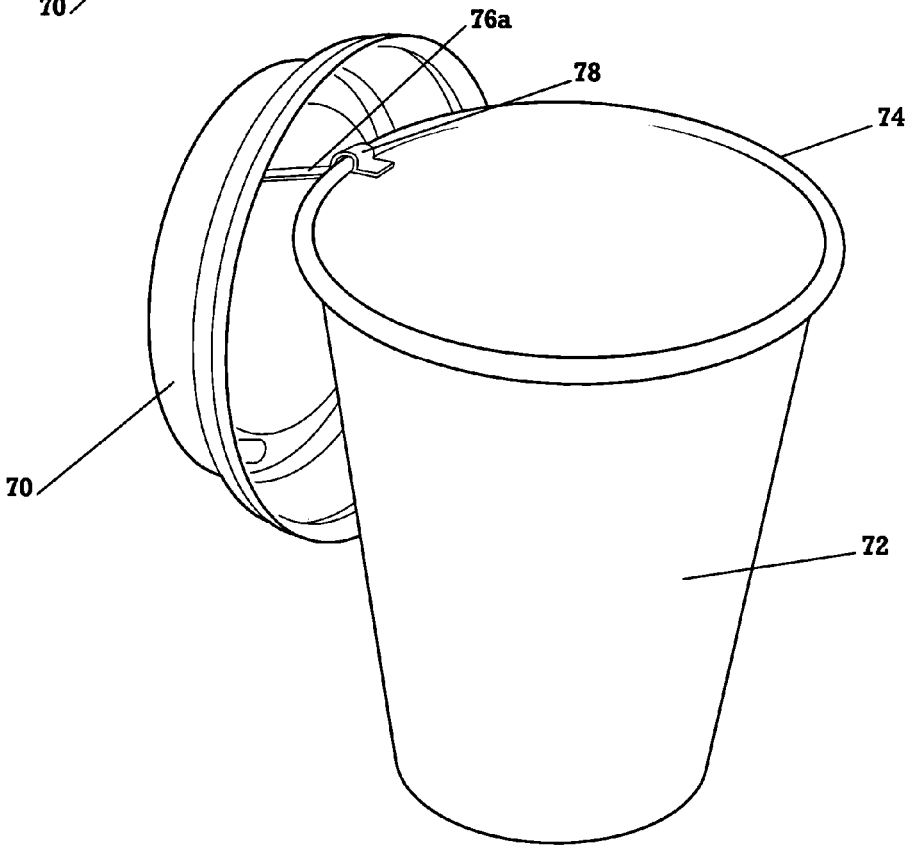
FIG. 17 is a perspective view, of the alternative embodiment of FIG. 15 shown in its temporary storage position on a representative beverage container.

Another embodiment of the invention is shown in FIGS. 12–17. Lid 70 includes protrusion 76 extending generally perpendicularly from the underside surface of lid 70 in a cantilevered fashion. Protrusion 76 includes hook 78 on its cantilevered end. While protrusion 76 is illustrated in FIGS. 12–14 as extending to a point slightly beyond the lower edge 80 of annular attachment portion 82, it is understood that protrusions of varying lengths can be employed, thereby controlling the angle at which lid 70 rests when temporarily affixed to cup 72 in the open position, as illustrated in FIG. 14.

Protrusion 76 in FIGS. 12–14 may initially be manufactured as a separate piece, such as through injection molding, that is later fixedly attached to the underside of lid 70 via any one of many well-known fastening means, such as by gluing, etc. (see FIGS. 12–14). Alternatively, protrusion 76 may optionally be manufactured integral and homogenously to the underside of lid 70 (see protrusion 76*a* in FIGS. 15–17), such as via injection molding or vacuum forming the entire lid/protrusion assembly. Preferably, lid 70 and protrusion 76/76*a* are made of disposable or recyclable materials, but lid 70 and protrusion 76 may individually comprise similar or different materials.

Lid 70 of FIGS. 12–17 may be adapted to permit improved stacking capabilities for more efficient packaging, storage and transportation. For example, in embodiments where protrusion 76/76*a* extend outward from lid 70 past the plane of lid edge 80, the material stiffness and geometry of protrusion 76/76*a* and hook 78 may be selected such that hook 78 curls to a semi-closed position when pressure is applied axially along protrusion 76/76*a*. Alternatively, protrusion 76/76*a* may be adapted to bend at the junction with the underside of lid 70, such that protrusion 76/76*a* can be temporarily positioned to lie approximately flush with the underside of lid 70, thereby facilitating stacking above another like cup lid.

In each of the embodiments, it is to be understood that the cups, and associated lids, may be provided in different sizes, shapes, and materials, without inhibiting deployment of the present invention. In addition, it should be understood that each of the embodiments are not limited to merely beverage container lids, and may be directed to lids for other types of containers, as well.

The foregoing description and drawings merely explain and illustrate the invention, and the invention is not so limited as those skilled in the art who have the disclosure before them will be able to make modifications and variations therein without departing from the scope of the invention.

I claim:

1. A lid adapted for removable attachment to a cup having a rim, which lid comprises:

a generally circular top surface;

an annular side wall contiguous to the periphery of the top surface and extending downward from the top surface, the annular side wall being comprised of an annular coupling surface formed in the annular side wall for removably securing the lid to the cup rim in an attached position;

a first aperture in the annular side wall extending upwards from the lower edge of the annular side wall;

a second aperture in the annular side wall extending upwards from the lower edge of the annular side wall and spaced apart from the first aperture;

at least one dispensing aperture in the generally circular top surface through which the cup contents can be dispensed when the lid is secured to the cup in the attached position;

wherein the lid can be mounted onto the cup rim while leaving the contents of the cup accessible when the cup rim passes through the first and the second apertures.

2. The lid according to claim 1, wherein the first aperture and the second aperture are generally parabolic in shape, the widest portion of the aperture residing along the lower edge of the annular side wall.

3. The lid according to claim 1, in which the first and second apertures do not extend upwards into the annular side wall beyond the highest point at which the side wall contacts the cup rim when the lid is in the attached position.

4. The lid according to claim 1, which lid is made from a disposable or recyclable material.

5. The lid according to claim 4, wherein the disposable or recyclable material is a thermoplastic material.

6. A lid adapted for removable attachment to a cup having a rim, which lid comprises:

a generally circular top surface;

an annular side wall contiguous to the periphery of the top surface and extending downward from the top surface, the annular side wall being comprised of an annular coupling surface formed in the annular side wall for removably securing the lid to the cup rim in an attached position;

a first aperture in the annular side wall extending upwards from the lower edge of the annular side wall;

a second aperture in the annular side wall extending upwards from the lower edge of the annular side wall and spaced apart from the first aperture;

in which the first aperture is spaced from the second aperture along the annular side wall by a distance of approximately one-tenth of the circumference of the annular side wall;

wherein the lid can be mounted onto the cup rim while leaving the contents of the cup accessible when the cup rim passes through the first and the second apertures.

7. The lid according to claim 1, on which the dispensing aperture is positioned near the periphery of the top surface, and the first and second apertures are located along the annular side wall at positions approximately opposite the dispensing aperture.

* * * * *